United States Patent [19]

Garland et al.

[11] Patent Number: 4,671,495

[45] Date of Patent: Jun. 9, 1987

[54] PARTICULATE MATERIAL CONTROL APPARATUS

[75] Inventors: G. Gray Garland, Pittsburgh, Pa.; Margaret G. Garland, 5040 Warwick Ter., Pittsburgh, Pa. 15213

[73] Assignee: Margaret G. Garland, Pittsburgh, Pa.

[21] Appl. No.: 848,927

[22] Filed: Apr. 7, 1986

[51] Int. Cl.[4] ..... E01F 7/02

[52] U.S. Cl. ..... 256/12.5; 256/26; 104/279

[58] Field of Search ..... 256/12.5, 26; 104/279

[56] References Cited

U.S. PATENT DOCUMENTS

| | | | |
|---|---|---|---|
| 48,464 | 6/1865 | Walrad | 256/12.5 |
| 284,900 | 9/1883 | Rice . | |
| 329,640 | 11/1885 | Gleason . | |
| 490,545 | 1/1893 | Dixson . | |
| 1,749,068 | 3/1930 | DeLand . | |
| 2,974,934 | 3/1961 | White | 256/13.1 |
| 3,473,786 | 10/1969 | Luebke . | |
| 4,089,179 | 5/1978 | Trautman | 256/12.5 X |
| 4,174,096 | 11/1979 | Campbell | 256/26 X |
| 4,498,660 | 2/1985 | Brema et al. . | |

*Primary Examiner*—Andrew V. Kundrat

*Attorney, Agent, or Firm*—Buell, Ziesenheim, Beck & Alstadt

[57] ABSTRACT

A particulate material control apparatus is disclosed which includes longitudinally extending fin members attached at one end to a vertical post. The fin members are capable of rotating about the vertical post in an arc limited by adjacent posts or other stopping mechanisms. The fin members close against an adjacent post when wind or water currents flow across the area to be protected preventing wind or water erosion of sand, silt or soil in that area.

12 Claims, 8 Drawing Figures

Fig. 4A.
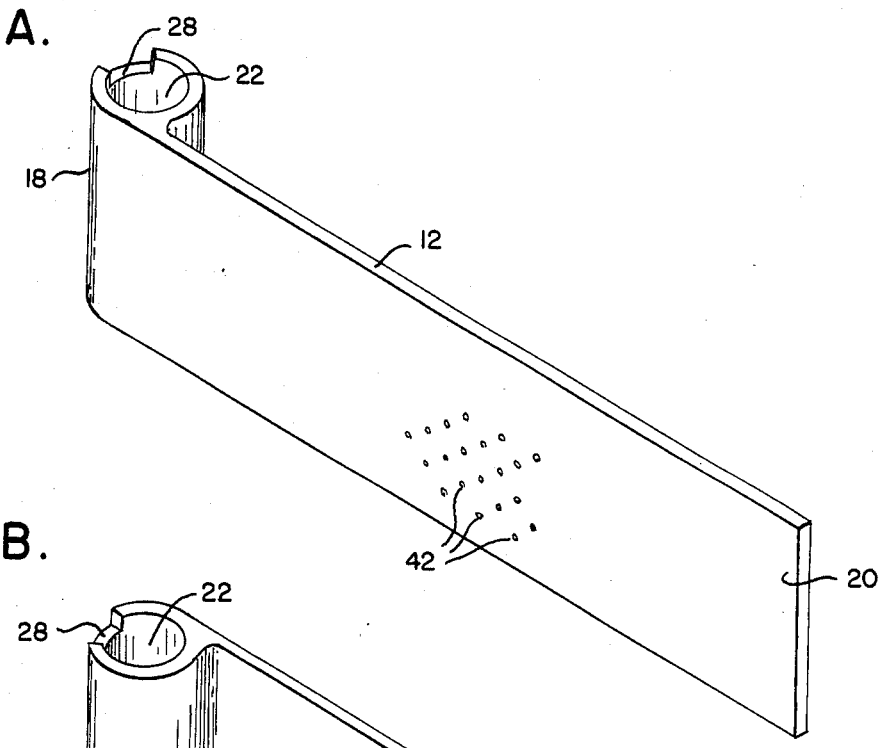
Fig. 4B.
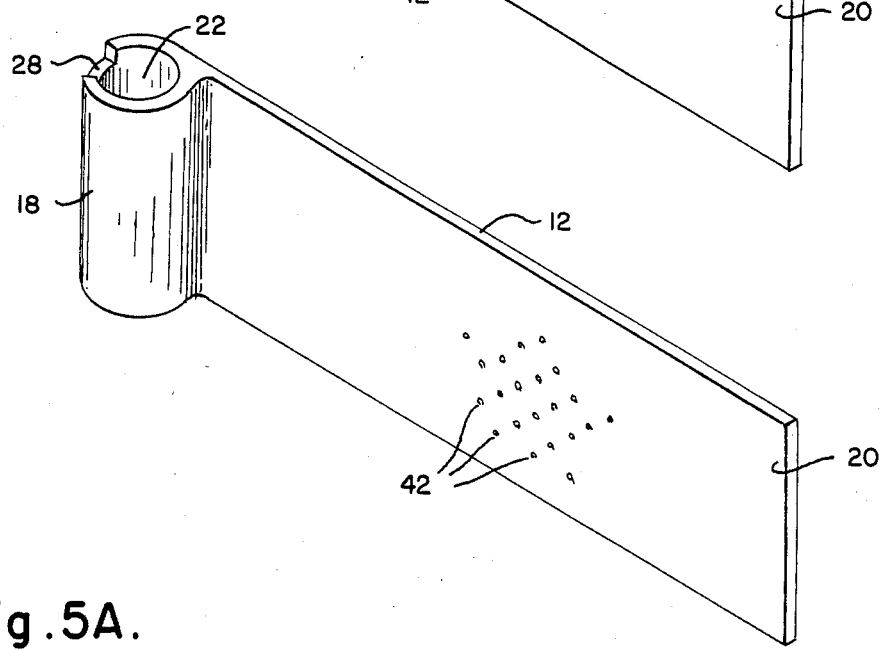
Fig. 5A.
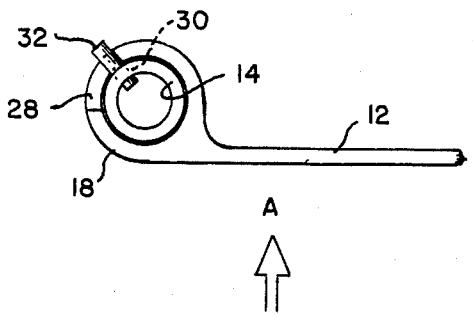
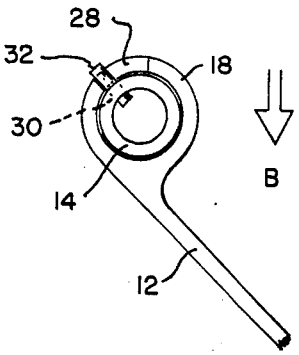
Fig. 5B.

PARTICULATE MATERIAL CONTROL APPARATUS

FIELD OF THE INVENTION

This invention relates to a particulate material control apparatus and, more specifically, to a fence construction particularly suitable for the prevention of wind and water or tidal erosion of sand and soil. The fence, comprising independently rotating fin members swinging about a vertical post, operates in such a manner as to permit sand or soil to enter a protected area. However, the fence will not permit the wind, water and tides to remove sand or soil from this protected area.

DESCRIPTION OF THE PRIOR ART

Various types of fences have been used in the past in an effort to control the wind-swept transfer of particles, generally snow. These fences have been used not to collect snow but to prevent the accumulation of snow by either diverting the wind-swept snow away from a particular area or diverting the wind in an effort to clear the accumulation of snow at particular points, generally railroad rights-of-way.

These fences have used pivoting vane members or mechanisms in which the entire apparatus pivots in response to the wind force and direction. However, in each of these fences, the rotation will divert the wind upward or downward or block the wind depending on the direction of the wind.

These fence designs are also characterized by a substantial degree of complexity, and it is often difficult to quickly assemble and disassemble them. It is also difficult to add on and expand these fences. Furthermore, it is difficult to obtain replacement parts and make any necessary repairs to the fences.

SUMMARY OF THE INVENTION

In accordance with the present invention, there is provided a fence construction particularly suitable for the prevention of sand and soil erosion. More particularly, the fence comprises posts which are driven into the ground and maintained a set distance apart by spacing means preferably in the form of stretchers. The stretchers have eyelets at each end which are fitted over the posts and may be secured at a selected height by pegs inserted into holes provided in the stem of the post. A plurality of horizontally extending, vertically disposed fin members with eyelets at one end are fitted over the posts and may be secured in the same manner as the stretchers. The fin members progress upwardly from the supported ground end of the posts. The diameter of the eyelet on each fin member is greater than the diameter of the post to permit each fin to independently swing freely. The length of each fin member is preferably greater that the separation distance between adjacent posts so that an adjacent post acts as a stop means preventing the fin members from swinging open away from the side of the fence at which the sand or soil is accumulated. Alternatively, stop means may be formed into the eyelet of each fin and on the posts. As the sand or soil accumulates, the lower fin members are buried while the uppermost fin members remain operational.

As the sand accumulates, extender posts can be placed on top of the existing posts in order to increase the height of the fence. These extender posts are equipped in a similar manner as the lower posts. In this manner, the fence serves to accumulate sand on the windward side of the fence, thus preventing the wind erosion of the sand or soil accumulated. The fence can be expanded, as needed, to prevent sand or soil erosion over an extended area, such as a beach front or farm. Also, the present invention may be used underwater to prevent erosion of sand or silt particles by tidal or other underwater currents.

BRIEF DESCRIPTION OF THE DRAWINGS

FIG. 4A is an isometric view of an alternate fin member of FIG. 1 showing a top notch;

FIG. 4B is an isometric view of the fin member of FIG. 4A showing a bottom notch;

FIG. 5A is a fragmented bottom view of the fin member of FIGS. 4A and 4B showing its relationship with a supporting peg in the closed position;

FIG. 5B is a fragmented bottom view of the fin member of FIG. 5A showing its relationship with a supporting peg in the open position;

DESCRIPTION OF THE PREFERRED EMBODIMENTS

Figure 1:
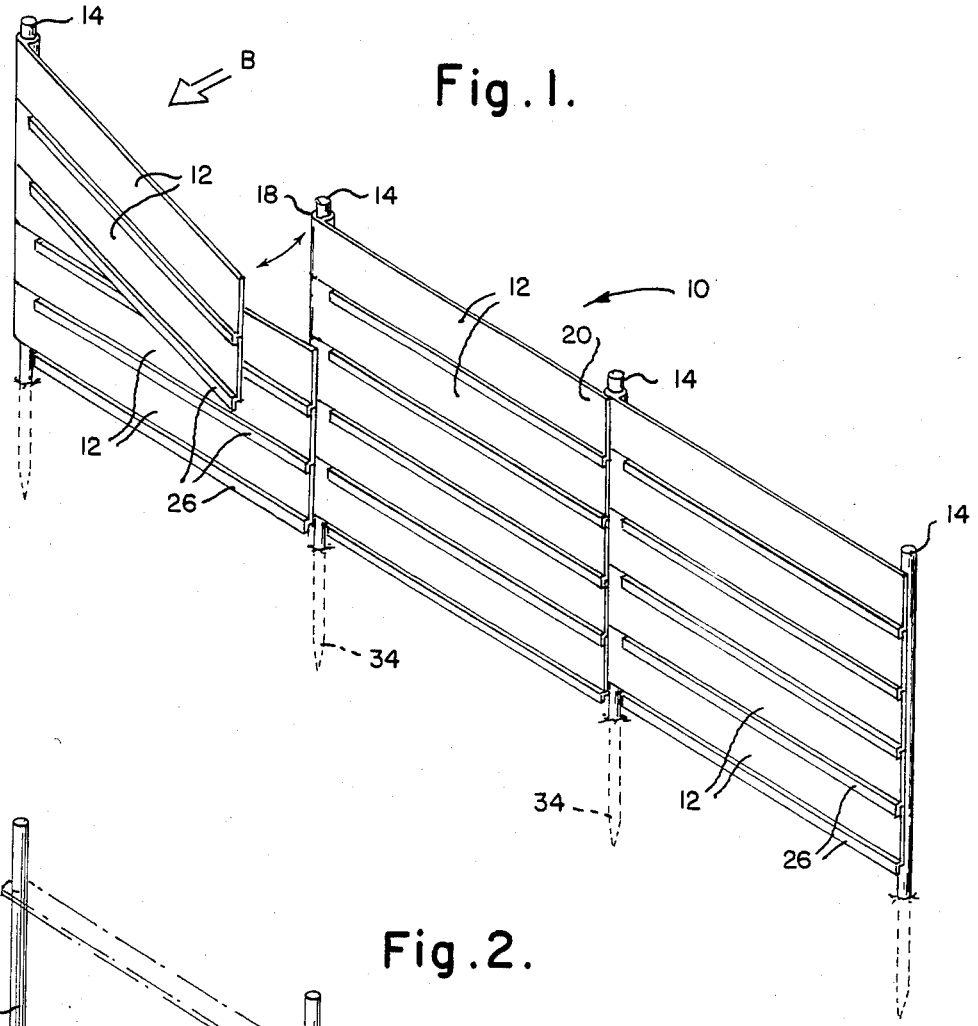
FIG. 1 is an isometric view of a fence assembly according to the present invention showing a plurality of posts each having a plurality of fin members attached thereto.

Particulate material control apparatus 10, also referred to as fence 10, preferrably is composed of three major components. The first major component are vertical posts 14. The second component are fin members 12. The third component, which are not required but are preferred, are stretchers 16. All three components are preferably fabricated from high strength plastic materials.

FIGS. 4A and 4B best illustrate the presently preferred embodiment of fin member 12 of the present invention. Fin member 12 extends hortizontally and has two distinct ends. One end 18 of fin member 12 is attached to vertical post 14 in such a manner as to allow rotation of fin member 12 about post 14. The other end 20 of fin member 12 extends substantially horizontally outward from attaching end 18. FIGS. 4A and 4B also show eyelet 22, the preferred method of attaching fin member 12 to post 14. It is to be understood that hinges or various other means readily apparent to those skilled in the art of fence design may be utilized to pivotally attach fin member 12 to vertical post 14.

Attaching end 18 of fin member 12 surrounds post 14 which extends through eyelet 22. The diameter of eyelet 22 is sufficiently greater than that of post 14 to allow fin member 12 to rotate freely around post 14. Fin member 12 is held in vertical position on post 14 by support means shown in the form of a peg 32 inserted into the desired bore 30 (FIGS. 5A and 5B) previous drilled into vertical post 14.

Vertical post 14 lies in a plane defined by the opposite windward and leeward sides of the fence 10.

Vertical post 14 is supported by driving sharpened end 34 (FIG. 3) into the ground. This subjacent support provides enough stability to post 14 to maintain its vertical postion. Metal inserts or inserts fabricated of plastic or wood may be provided within the stem of the posts to strengthen the posts to enable the posts to be driven into the ground. If desired, additional or replacement bracing means can be employed to support posts 14 in a vertical orientation. These additional means include providing a base into which post 14 is inserted, providing legs that attach to post 14 and angle out to provide lateral support, and other means that are readily apparent to one skilled in the art of fence design and construction.

Figure 2:
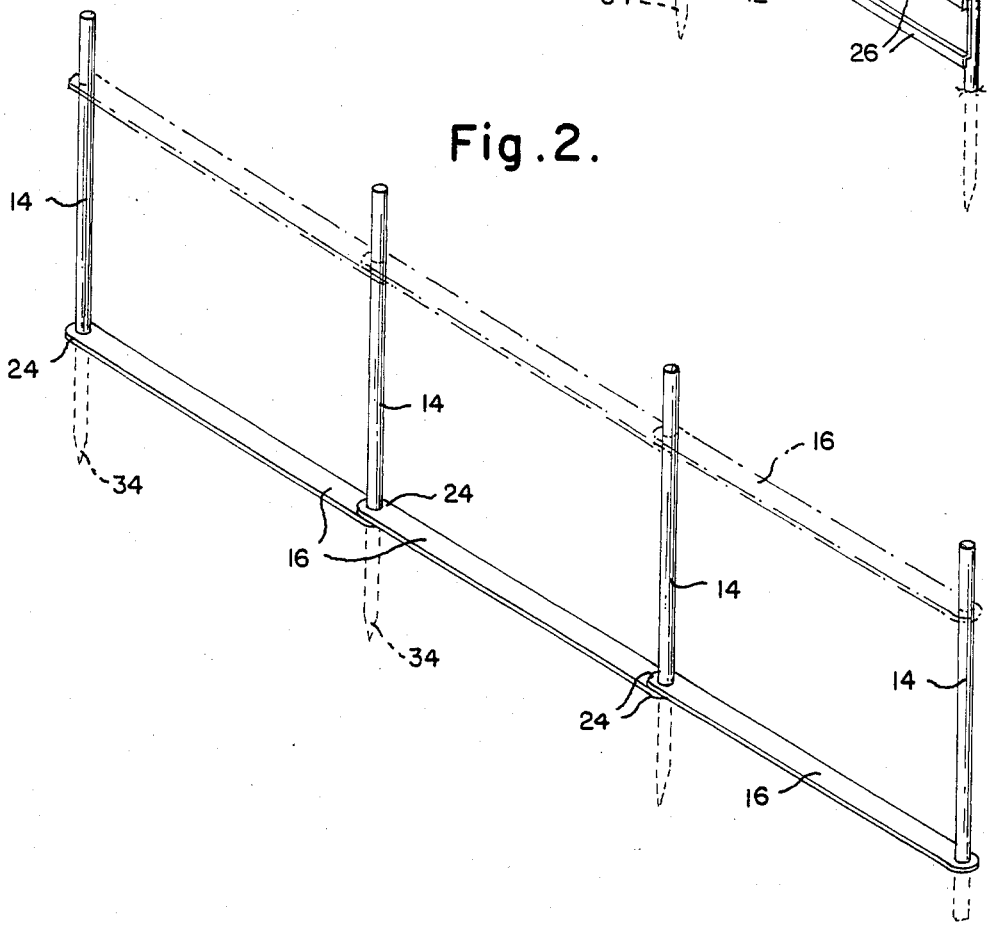
FIG. 2 is an isometric view of the posts of FIG. 1 as connected by stretchers.

FIG. 1 shows particulate material control apparatus 10 as constructed for operation. Fin members 12 progress upwardly from the secured end 34 of vertical post 14. FIG. 2 shows stretchers 16 are attached between vertical posts 14 by means of attaching end 24. Stretchers 16 provide strength to fence 10 and also maintain adjacent posts a set distance apart. This distance is preferably less than the length of fin member 12. Pegs 32 are inserted into bores 30 on each of said posts to maintain the vertical position of stretchers 16 at one or more desired vertical levels.

In operation, since the inner diameter of eyelet 22 is larger than the outer diameter of vertical post 14, fin member 12 is free to rotate around post 14. Unless additional stop means are employed, the only impediments to the free rotation of fin member 12 about a single vertical post 14 are the two adjacent posts. Since fin member 12 is longer than the space between vertical post 14 and either of its adjacent posts, rotation of fin member 12 will be restricted to an arc defined by the adjacent posts on either side of verticle post 14, usually 180°. The fin member 12, then, is free to rotate about vertical post 14 on only one side of said post 14. Furthermore, since each fin member 12 is attached independently to vertical post 14, each fin member 12 is capable of independent rotation about post 14.

In its operation as part of the particulate material control apparatus 10, each fin member 12 may independently rotate about vertical post 14 upon the applied force of wind or, if used underwater, by tidal or other water current forces. Free ends 20 of fin members 12 are urged to a position downwind relative to attached ends 18, unless restricted by adjacent posts or other stop means. Accordingly, when wind or water force is applied from one direction, called the windward direction, illustrated by arrow A, (FIGS. 3 and 5A) fence 10 will be closed. When wind or water force is applied from the other direction, the leeward direction, illustrated by arrow B, (FIGS. 1, 3 and 5B) fence 10 will open.

Figure 3:
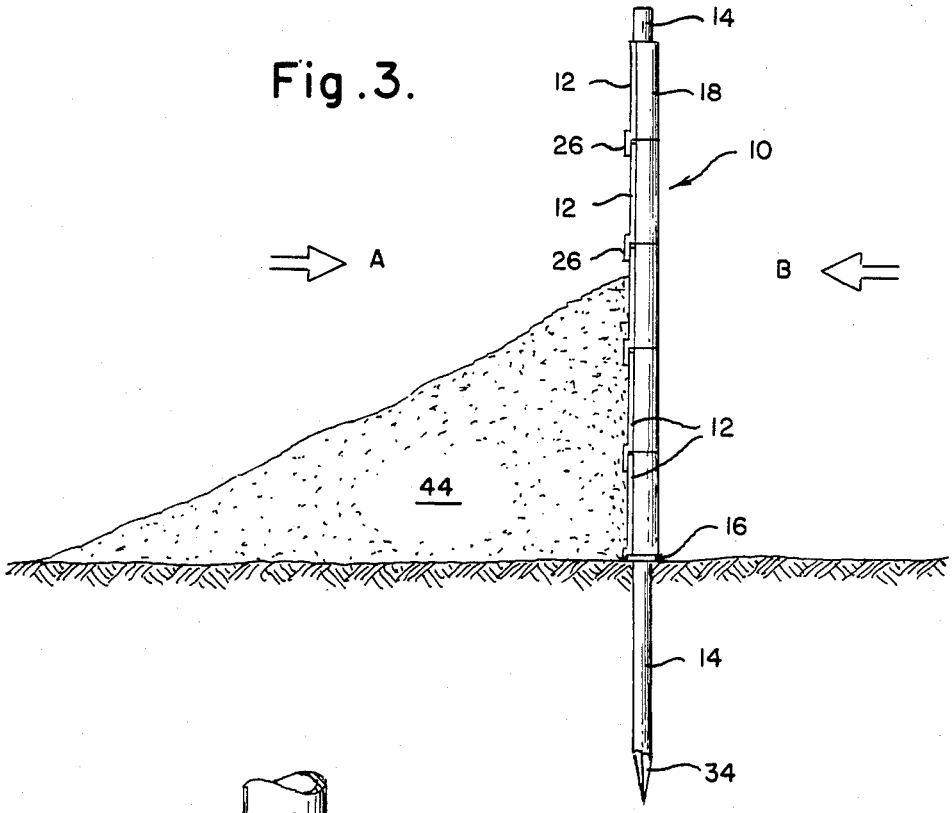
FIG. 3 is a side elevational view of the fence assembly of FIG. 1 also showing accumulated sand on a windward side thereof covering lowermost fin members.

Since fence 10 closes when wind or water forces are applied from the windward direction, the sand or soil on the windward side of fence 10 will not be blown or washed away. Rather, the transport of these wind or water swept particles will be blocked by the fin members 12 and be forced to settle at the base of fence. As the particles accumulate, they will build upon one another forming a mound 44 at the base of fence 10 as shown in FIG. 3. Over time, this mound will grow in height, successively burying the lower fin members 12.

When wind or water forces are applied from the leeward direction, fin members 12 that are not buried by the accumulated sand or soil on the windward side will rotate about post 14. Generally speaking, sand or soil particles on the leeward side of fence 10 will be free to enter the windward side of fence 10 when the wind or water current originates from the leeward direction.

It is apparent, then, that fin members 12 are free to rotate only within the windward side of the fence 10.

Accordingly, particulate material control apparatus 10 permits the accumulation of sand or soil on one side of fence 10 which would otherwise be blown or washed away. This sand accumulates at the base of fence 10 and prevents any buried fin member 12 from rotating back into the protected windward area.

Figure 6:
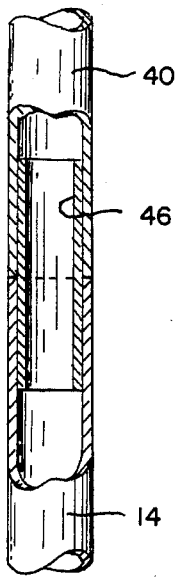
FIG. 6 is an isometric view partially broken away showing the attachment of an extender post to a lower post.

If the sand accumulation becomes great enough, extender posts 40 can be attached to the top of vertical posts 14 by means of splice tubes 46 as shown in FIG. 6. These extender posts 40 serve the same purpose as the underlying posts and can accomodate fin members 12 and stretchers 16. These extender posts allow for the collection of greater amounts of sand and provide for the construction of larger sand mounds.

Wind, water or tidal conditions may exist which cause fin members 12 of any two adjacent posts to close over the same opening in the fence 10. Since otherwise unrestricted, the fin members 12 can rotate through a 180° arc, there is a possibility that fin members on any two adjacent posts may swing in opposite directions and cover the same opening. This will leave a gap in another part of the fence 10. For this reason, additional stop means are preferably provided to further restrict the rotation of the fin member 12 to ensure that it will always close against the same adjacent post.

In the preferred embodiment, the stop means consists of notches 28 in the attaching end 18 of fin member 12. These notches 28 cooperate with supporting pegs 32 to limit the rotation of fin member 12 about vertical post 14. FIGS. 5A and 5B show the cooperation between notch 28 and peg 32. In FIG. 5A, the windward wind blows fin member 12 closed against an adjacent post. In FIG. 5B, the leeward wind blows fin member 12 open. However, peg 32, which fits in notch 28, prevents fin member 12 from rotating beyond the limits established by notch 28. In this manner, fin member 12 can rotate only though a limited arc and is forced to close upon only the same adjacent post. Limiting rotation of fin member 12 to an angle between 45° and 90° allows a sufficient opening for particles to freely pass by when open and also allows winds or water currents from a broad range of windward directions to cause the fin member 12 to close. Restricting the angle to less than 90° is preferred.

It is to be understood that, as shown in FIG. 5A, peg 32 can also be used to block rotation of fin member 12 about vertical post 14 toward the closed position. This will eliminate the need to use an adjacent post as a stop means, and also permits fin member 12 to be only as long as stretchers 16. It is also to be understood that various other means readily apparent to those skilled in the art of fence design may be utilized as stop means.

Various shapes can be utilized for the fin members 12 provided that the shape permits the fin member 12 to accomplish its essential purpose of preventing sand from escaping from the protected windward area. A flat rectangular fin member design is preferred. Additionally, fin members 12 can be constructed with lip 26 connected to the bottom of fin member 12 such that lip 26 overlaps the top portion of a lower fin member 12 as shown in FIGS. 1 and 3. This louvered design is particularly useful for conditions in which a maximum number of the particles must be contained. Other modifications obvious to one skilled in the art of fence design may also be used in the design and arrangement of fin members 12.

For example, if desired, small perforations 42 may be provided in fin members 12 to provide an additional drainage means for the removal of water from the mound of accumulated particles. In most cases, however, sufficient drainage will occur between vertically adjacent fin members 12.

It should be noted that the preferred embodiment of particulate material control apparatus 10 includes a variety of interchangeable parts. The vertical posts 14 are of standardized construction as are all fin members 12, stretchers 16, pegs 32 and extender posts 40. This provides for easy replacement of any damaged part of the assembly. If a fin member 12 becomes damaged, any fin member or the type shown in FIGS. 4A, 4B, 5A and 5B can take its place since they are all standard and since they are all constructed with notches 28 on both the top and bottoms of attaching end 18 so that they can be used whether rotation toward the closed position is clockwise or counterclockwise. However, where a fin member 12 of the type shown in FIGS. 1 and 3 having a lip 26 is used, a replacement fin member must have the same clockwise or counterclockwise orientation. Furthermore, this standardized construction facilitates the simple assembly and disassembly of the particle control apparatus 10. Finally, parts are preferably fabricated from a non-corosive material such as plastic for example, or have a corosion resistant coating applied to the outer surface to protect against exposure of materials to the wind, weather and particulate matter and also to prevent corosion from saltwater or airborn salt at a seashore.

The particulate material control apparatus 10 can also accomodate some ornamental features. Caps can be utilized to provide a finished look to the top of vertical posts 14. In addition to this ornamental function, these caps would further secure the fin members 12 and also provide a smooth surface so that one could walk on the caps without injury should the sand or soil be accumulated to the top of the vertical post 14. Finally, the fin members 12 can be made is various colors to enhance the attractiveness of the fence 10.

Although the invention has been shown and described in connection with certain presently preferred embodiments, it will be readily apparent to those skilled in the art that various changes in form and arrangement of parts may be made to suit requirements without departing from the spirit and scope of the invention as set further in the following claims.

We claim:

1. A containment apparatus to enable the build-up of particulate material on one side of said apparatus comprising:

(a) at least a first post in a plane defining opposite sides of said apparatus and having a lower supported end and having an opposite end extended upwardly therefrom;

(b) a plurality of horizontally extending, vertically disposed fin members progressing upwardly from said supported end, each of said fin members having a free end and one end thereof pivotally attached to said first post to allow each said fin member to independently rotate within one side of said plane about its pivotal attachment; and (c) stop means associated with said fin members to limit rotation of each fin member to a desired arc of rotation between an open and a closed position within said one side, wherein each fin member permits said particulate material to enter said one side when in said open position and prevents said particulate material to pass when in said closed position.

2. Apparatus according to claim 1 wherein said one end of said fin member is formed into a substantially round eyelet having an opening therein of sufficient diameter to permit said fin member to swing freely around said first post.

3. Apparatus according to claim 2 wherien said stop means comprises a notch in said eyelet and further comprises a bore in said first post into which a peg is inserted whereby said peg is interposed within said notch in order to restrict rotation of said fin member.

4. Apparatus according to claim 1 wherein said stop means restricts rotation of each said fin member to an arc less than 90 degrees.

5. Apparatus according to claim 1 furthere comprising support means attached to said post wherein said support means holds each fin member in a desired vertical position on said post.

6. Apparatus according to claim 5 wherein said support means comprises a plurality of bores in said post and further comprises a plurality of pegs which are inserted into said bores to maintain each fin member in a desired vertical position on said post.

7. Apparatus according to claim 1 further comprising post extenders attached to each said opposite end of each said first and a second post and extending upwardly therefrom.

8. Apparatus according to claim 1 further comprising perforations in said fin members.

9. Apparatus according to claim 1 wherein said stop means further comprises a second post spaced apart from said first post a distance less than the length of said fin members whereby rotation of each fin member toward said second post is restricted by said second post and rotation away from said second post is unrestricted of said second post.

10. Apparatus according to claim 9 further comprising spacing means attached at one end thereof to said first post and at the opposite end thereof to said second post to maintain said first post a predetermined distance from said second post.

11. Apparatus according to claim 10 wherein said spacing means is a stretcher having round eyelets at opposite ends thereof adapted to fit over said first post and said second post, respectively.

12. Apparatus according to claim 10 further comprising support means attached to said post wherein said support means holds at least one of said each fin member and each spacing means in a desired vertical position on said first and second posts.

* * * * *